United States Patent [19]

Yorgan

[11] Patent Number: 4,716,891

[45] Date of Patent: Jan. 5, 1988

[54] INTERSEGMENTAL TRACTION APPARATUS FOR THE CERVICAL SPINE

[76] Inventor: Kenneth J. Yorgan, 901 S. Green Bay Rd., Racine, Wis. 53406

[21] Appl. No.: 861,866

[22] Filed: May 12, 1986

[51] Int. Cl.[4] ..... A61H 15/00

[52] U.S. Cl. ..... 128/57; 128/24.3; 128/46

[58] Field of Search ..... 128/24.3, 24.4, 45–47, 128/56, 57

[56] References Cited

U.S. PATENT DOCUMENTS

| | | | |
|---|---|---|---|
| 86,604 | 2/1869 | Taylor | 128/57 |
| 3,398,741 | 8/1968 | Burk | 128/57 |
| 3,878,837 | 4/1975 | Werding | 128/57 |

*Primary Examiner*—Clyde I. Coughenour

*Attorney, Agent, or Firm*—Law Firm of Peter N. Jansson, Ltd.

[57] ABSTRACT

An improved device for applying intersegmental traction therapy to the cervical spine, including an array of alternating lifting and intervening rollers dimensioned and positioned on the array such that when a lifting roller is centered on a patient's cervical spine, it is the only roller in supporting contact with the patient's neck, while when one of the intervening rollers is centered on the patient's cervical spine, lifting rollers on either side thereof are in supporting contact with the patient's neck. The lifting rollers are preferably soft and resilient.

4 Claims, 5 Drawing Figures

FIG. 4
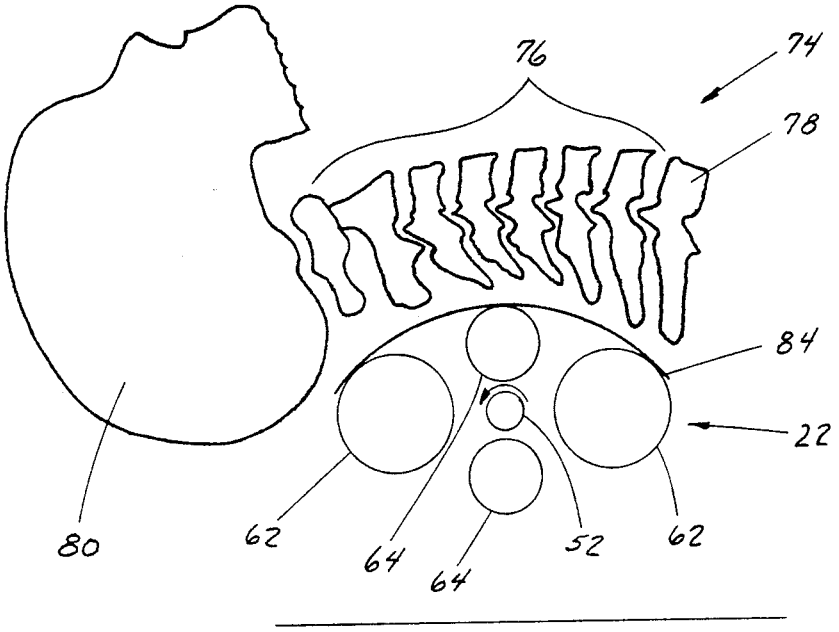
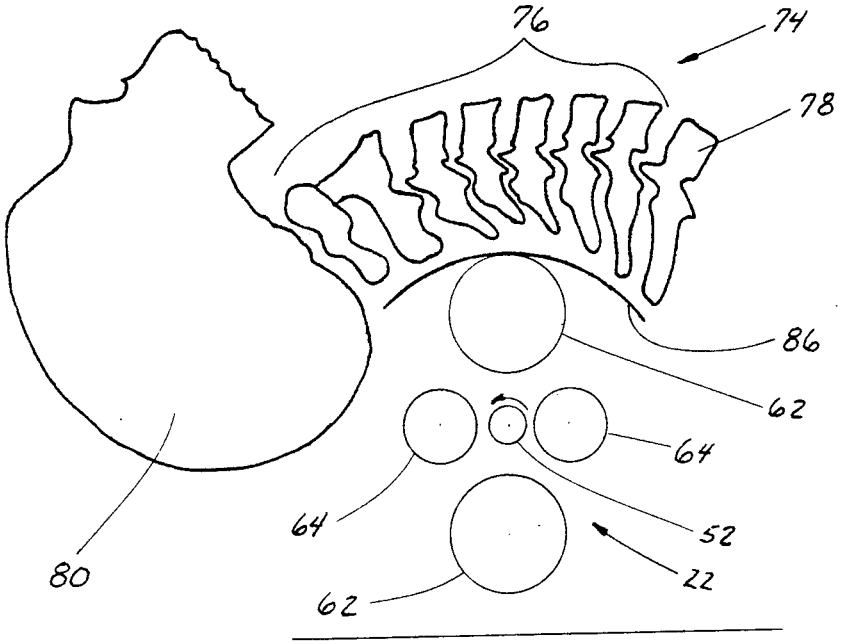
FIG. 5

INTERSEGMENTAL TRACTION APPARATUS FOR THE CERVICAL SPINE

FIELD OF THE INVENTION

This invention is related generally to apparatus for treatment of the spine and, more particularly, to apparatus for applying intersegmental traction to the cervical spine.

BACKGROUND OF THE INVENTION

The normal human vertebral column, viewed laterally, presents four distinct curves. Two of these, the cervical (neck) and lumbar (lower back) curves, are concave toward the posterior side of the body and are referred to as lordotic curves, while the other two, the thoracic (chest) and pelvic curves, are convex toward the posterior side.

These four curves are extremely important to such spinal functions as weight bearing, shock absorbance, balance, and normal efficient biokinetics. The loss of any of the four curves can and does compromise these spinal functions and results in diminished health and well-being.

The cervical lordotic curve extends from the base of the skull to the second thoracic vertebra, and includes all seven neck bones and the first thoracic vertebra. This curve is frequently damaged by trauma such as sports injuries, auto accidents (e.g., whiplash), and postural stress and strain due to occupational demands or even improper sleep habits.

Once this curve is lost or altered, the normal dynamics of the cervical spine and the inter-relationships of the cervical vertebrae and associated soft tissue (muscles, ligaments, tendons, and other connective tissue) are changed. Stresses due to normal activity, which were previously efficiently dissipated, will now impose on structures which were not intended to receive them. Repetitive micro-trauma begins to occur and over a prolonged period additional structural changes take place as the body attempts to respond to this continued assault.

Various kinds of cervical arthritis eventually manifest themselves and "old age" sets in. Formerly normal activities are either greatly reduced or accomplished only with pain. Fatigue and pain syndromes can become chronic. Thus, therapeutic steps designed to correct and maintain the cervical lordotic curve are of significant importance to the current and future health and well-being of a person having problems associated with loss or alteration of such curve.

Applying intersegmental traction to the spine has been a part of chiropractic for many years. Its benefits include mobilization of the spinal motor units, stimulation of vascular and lymphatic circulation, relieving pressure from inflamed and irritated nerves, relaxation of paraspinal muscles, and relief of fixations and restoration of resilience to discs and other connective tissue.

Intersegmental traction for the cervical portion of the spine is deemed to be helpful for all of these reasons. Proper application of intersegmental traction to the cervical spine is very helpful toward restoration of the cervical lordodic curve.

A variety of devices have been used for massaging the spine, including some specifically designed for massage of the cervical spine. A number of such prior devices include a moving, usually rotating, array of rollers, typically parallel idling rollers, which pass seriatim over the back of a patient's neck usually in a headward direction as the patient lies with his neck across the rotating array. Such devices usually impart some movement to the cervical spine. But these prior art devices have significant drawbacks or cause significant problems during use.

Directly in point is the fact that some of such prior devices, while providing some minor lifting action by movement of a roller or series of rollers across the cervical spine, fail to apply effective intersegmental traction. In certain prior devices, such failure is a result of failing to lift the central portion of the cervical spine by a sufficient distance, with the remainder of the cervical spine being unsupported, to allow the weight of the patient to apply tractional force to the cervical spine.

Such insufficient lifting and the resultant inadequate intersegmental traction may be the result when an array of rollers or other objects which pass across the spine are too closely spaced together to cause sufficient intermittent thrusting motions to the cervical spine. Rather than causing a significant wave-like lifting actions across the cervical spine, such rollers act merely to massage the surface. So no significant intersegmental traction is applied.

Certain other devices of the prior art, while providing somewhat greater lifting action, have other disadvantages. In particular, such devices repeatedly cause all or a significant length of the cervical spine to span two widely spaced rollers with no support for the central portion of the cervical spine which is between such spaced rollers.

Without intervening support, improper and unnecessary strains are periodically placed on the cervical spine, causing the curve of the cervical spine to flatten or even reverse. This is counterproductive to the intent of the therapy, and, particularly in someone who has undergone tissue and/or structural damage or degeneration, can be quite uncomfortable.

There is a need for an improved apparatus to apply intersegmental traction to the cervical spine. There is a need for an apparatus which can provide an intermittent pronounced lifting action rolling across a patient's cervical spine. In particular, there is a need for a device having this advantage and yet providing support for the center of the cervical spine between the intermittent pronounced lifting motions.

SUMMARY OF THE INVENTION

This invention is an apparatus for applying intersegmental traction to the cervical spine. The invention overcomes the problems and disadvantages of devices of the prior art.

The intersegmental traction apparatus of this invention includes a plurality of spaced elongated support means, which are parallel to each other and which pass seriatim over the back of a patient's neck, such support means being in two different sets, including a set of lifting support means and a set of intervening support means. The lifting support means have neck-contact points spaced a first distance from a fixed reference point and the intervening support means have neck-contact points spaced a second distance from the fixed reference point. The first distance is greater than the second distance such that lifting and relaxing motions are applied to the cervical spine.

The lifting support means and intervening support means are positioned, dimensioned and arranged such that the passage of such support means seriatim over the back of a patient's neck, when the patient is lying with the back of his neck over such support means, imparts periodic lifting strokes to the cervical spine in which a single lifting support means is centered on the cervical spine is the only means supporting the cervical spine, and, when an intervening support means is centered on the cervical spine, the spine is supported by it as well as by lifting support means on either side thereof.

It is highly preferred that all of the support means be rollers, preferably idling rollers. The lifting support means are preferably a single roller, referred to as a "lifting" roller, and the intervening support means are preferably at least one (and most preferably one) roller, referred to as an "intervening" roller.

The most highly preferred forms of this invention include an array of elongated parallel rollers which is rotatable about a main axis parallel to and spaced from the rollers. The array of rollers includes a set of lifting rollers and a set of intervening rollers. The lifting rollers are spaced substantially equally about the main array axis and are at a first radial distance from the main axis. The intervening rollers are also spaced substantially equally about the main axis, at positions between, and preferably equidistant between, the lifting rollers, each intervening roller being at a second radial distance from the main axis. The first radial distance is greater than the second radial distance. Furthermore, the diameter of the lifting rollers is greater than the diameter of the intervening rollers.

The array of rollers is preferably rotatable in a direction such that successive rollers are moving along a patient's cervical spine toward the patient's head. This is the preferred direction of movement.

In preferred embodiments, the lifting rollers have soft resilient outer surfaces. The lifting rollers preferably include an inner rod over which an annular foam outer member is located. Such soft resilient surface mitigates the effects of the substantial lifting of the cervical spine which is imparted by to it by the lifting rollers.

In highly preferred embodiments, there are two lifting rollers and such lifting rollers are spaced about 180 degrees apart around the main axis of the array. Likewise, there are preferably two intervening rollers which are spaced 180 degrees apart around the main axis of the array. While two of each type of such spaced rollers is highly preferred, it is possible to have a greater number—three, for example.

And, while a single intervening roller is preferred between each pair of lifting rollers, two or more properly located and dimensioned intervening rollers can be used. If more than one intervening roller is used between each adjacent pair of lifting rollers, the diameters of the intervening rollers should usually be smaller than would otherwise be the case, in order to maintain the pronounced lifting effect of the lifting rollers on the cervical spine.

In certain preferred embodiments, a pliable motion-transmitting cover sheet is secured over the rotatable array of rollers in contact therewith. Such cover sheet, which may itself have a padding of foam or otherwise, is in position right over the point at which the rotatable array of rollers, if uncovered, would contact the back of a patient's neck. The motion of the rollers in the rotating array is transmitted through the cover sheet to the back of the patient's neck. The apparatus of this invention may be used with or without such a cover sheet.

The dimensions and locations in the array of the lifting and intervening rollers are such that, when a lifting roller is positioned against the center portion of a patient's cervical spine, it is the only roller in the rotating array to be supporting the cervical spine. Furthermore, by virtue of the dimension and location of such lifting roller in the array, it lifts the cervical spine a considerable distance over the position at which it is supported when such lifting roller is not near the center of the patient's cervical spine.

And, the rollers are spaced, dimensioned and arranged such that when one of the intervening rollers is located at or near the center of a patient's cervical spine, lifting rollers on either side thereof are also in supporting contact with the patient's neck. Stated differently, when two lifting rollers are located near the opposite ends of a patient's cervical spine in supporting contact with the spine, the intervening roller between such lifting rollers is located at or near the center of the patient's cervical spine and is also in supporting contact with the patient's neck. This eliminates situations in which the cervical spine spans a substantial distance in unsupported fashion, and could tend to flatten or reverse its curvature.

Highly preferred relative dimensions of lifting and intervening rollers and radial positions are given herein.

OBJECTS OF THE INVENTION

It is an object of this invention to provide an improved intersegmental traction apparatus overcoming certain problems and deficiencies in devices of the prior art.

Another object of this invention is to provide a device for treatment of the cervical spine which applies substantial intersegmental traction.

Another object of this invention is to provide a device for applying intersegmental traction to the cervical spine having improved comfort and effectiveness.

Another object of this invention is to provide a device which applies substantial intersegmental traction from repetitive therapy strokes without intervening periods in which there is insufficient support for the cervical spine.

These and other objects will be apparent from the following additional descriptions and from the drawings, wherein:

BRIEF DESCRIPTION OF THE DRAWINGS

FIGS. 4 and 5 are schematic views illustrating the operation of the apparatus of this invention.

DETAILED DESCRIPTIONS OF PREFERRED EMBODIMENTS

Figure 1:
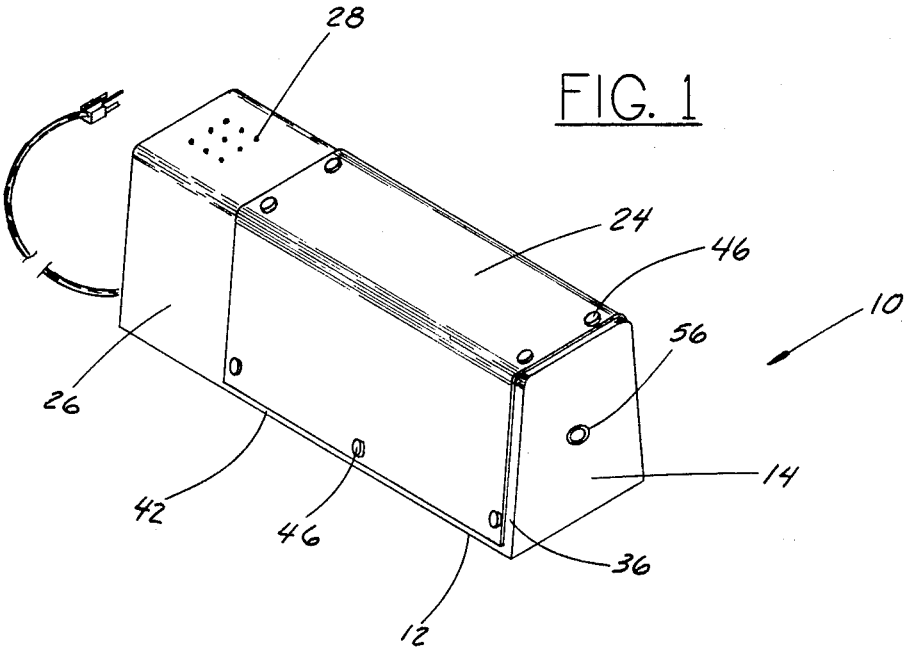
FIG. 1 is a perspective view of a preferred embodiment of this invention.
Figure 2:
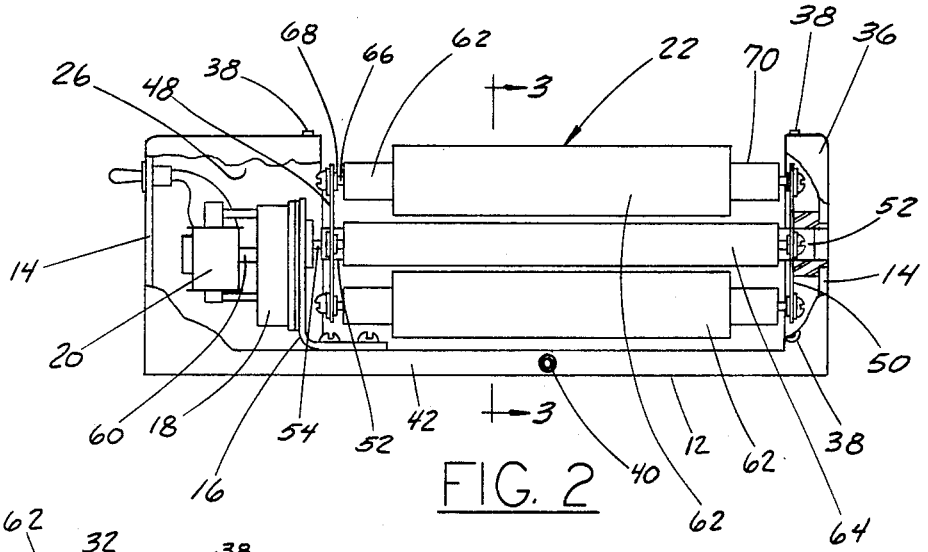
FIG. 2 is an enlarged partially cut away front elevation of FIG. 1, with the pliable cover removed.
Figure 3:
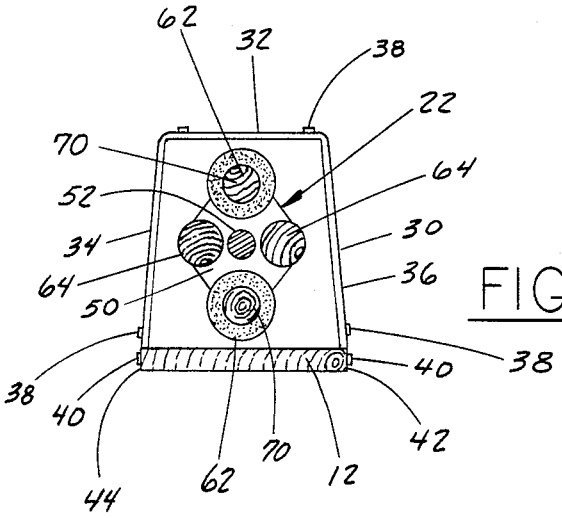
FIG. 3 is a right sectional view taken along section 3—3 as indicated in FIG. 2.

The drawings illustrate a preferred intersegmental traction applying device 10 for treatment of the cervical spine. The device is preferably wide enough from end to end and strong enough to support the back of an adult's neck for therapy in the manner described.

Traction device 10 includes a rectangular base member 12, a pair of upright end members 14 secured to base member 12, a pair of upright support members 16 secured to base member 12 immediately adjacent to each other at a position between end members 14, a reduction gear assembly 18 secured to upright support members 16, an electric motor 20 attached to reduction gear assembly 18, a rotatable array 22 of cervical spine-treating rollers, and a cover sheet 24 surrounding roller array 22.

A casing 26 is attached to one of the end members 14 and to base member 12. Casing 26 encases electric motor 20 and reduction gear assembly 18 and has ventilation holes 28 therein to help keep the motor cool. Secured to the other end member 14 are short front, top, and back walls 30, 32, and 34, respectively, together forming a short surrounding wall 36 which is aligned with casing 26.

Short surrounding wall 36 and casing 26 are spaced from one another along traction device 10 by an amount sufficient to fully expose rotating array 22. Along the edges of casing 26 and short surrounding wall 36 are a number of male snap members 38. Middle male snap members 40 are along the front and back edges 42 and 44 of base member 12. Cover sheet 24 has corresponding female snap members 46 located to engage each of the male snap members to hold cover sheet 24 in position over rotatable array 22.

Rotatable array 22 is dimensioned in cross-section such that its peripheral edges will contact cover sheet 24 because of the pliability of sheet 24. Furthermore, the pliability of cover sheet 24 is sufficient such that a patient's neck will be supported through cover sheet 24 by whatever roller or rollers are in an upper position, regardless of their dimensions and their distances from the center of the array.

Rotatable array 22 includes rotatable carrier plates 48 and 50. Extending between carrier plates 48 and 50 is a central shaft 52. Central shaft 52 is affixed to carrier plates 48 and 50 and is keyed to drive shaft 54, which extends from reduction gear assembly 18 in a gap (not shown) between the two upright support members 16. At the opposite end of rotatable array 22, central shaft 52 is journaled in a nylon bushing 56 which is secured to end member 14 at that end.

Electric motor 20, which is controlled by on-off switch 58, has an output shaft 60 which functions as the input shaft for reduction gear assembly 18. When electric motor 20 is running, drive shaft 54 is turning slowly with a relatively high torque so that it may drive the rotation of rotatable array 22, even when the weight of a patient's body is placed thereon during therapy.

Two different pairs of rollers extend between carrier plates 48 and 50. These include two lifting rollers 62 and two intervening rollers 64. Each of these rollers has a fixed screw shaft 66 at either end and each of the screw shafts 66 is journaled in a bushing 68 affixed to one of the carrier plates, such that all four rollers are freely rotatable idling rollers.

As noted, rotatable array 22 rotates with central shaft 52. That is, rotatable array 22 rotates about the axis of central shaft 52, which is referred to herein as a main axis. Each of the four rollers 62 and 64 is parallel to and spaced from such main axis.

Lifting rollers 62 are each spaced from the main axis by a first radial distance, and intervening rollers 64 are each spaced from the main axis by a second radial distance. The first radial distance is greater than the second radial distance such that lifting rollers 62 are each centered at a greater distance from the main axis than each of the intervening rollers 64. Lifting rollers 62 are similar to each other in every respect. Likewise, intervening rollers 64, while much different from lifting rollers 62, are identical to each other in every respect.

The diameter of each lifting roller 62 is significantly greater than the diameter of each intervening rollers 64. Indeed, the diameter of lifting rollers 62 is preferably at least one-third greater than the diameter of intervening rollers 64, and, most preferably, on the order of twice as great as the diameter of intervening rollers 64.

Furthermore, lifting rollers 62 are centered at a radial distance from the main axis which is preferably at least one-fourth greater than the radial distance at which intervening rollers 64 are centered from such main axis. Most preferably, the radial locations of lifting rollers 64 are on the order of fifty percent farther from the main axis than the radial locations of intervening rollers 64. Such radial locations and such diameters combined to produce very effective intersegmental traction, as will hereafter be described in greater detail.

The four rollers are spaced at 90 degree intervals around the main axis. Lifting rollers 62 are at 180 degree intervals from each other and intervening rollers 64 are also at 180 degree intervals from each other. As earlier noted herein, it is highly preferred that there be four rollers in all—two lifting rollers 62 and two intervening rollers 64. However, in some cases, with appropriate roller sizes, spacings and radial locations, there can be a greater number of rollers and still achieve the improvements in intersegmental traction provided by this invention.

In a preferred form, intervening rollers 64 are wooden dowels. However, a wide variety of alternative materials could be used, including metals and certain hard plastics. The surface characteristics of intervening rollers 64 can vary, although it is highly preferred that their surfaces be firm. Lifting rollers 62 each have a cylindrical inner rod 70 and an annular foam outer member 72. Foam outer member 72 may be attached over inner rod 70 in any convenient manner, such as by use of an adhesive. Or, annular outer member 72 can be made freely rotatable on a hard inner member which forms an axle for it.

A patient requiring therapy of the cervical spine will lie with the back of his neck over rotatable array 22, with or without cover sheet 24 between his neck and the rollers. Rotatable array 22 is preferably centered on the cervical spine. When traction device 10 is turned on, the motion of rotatable array 22 against the patient's neck will be in a direction up the patient's spine, that is, toward the patient's head.

The array will preferably rotate at a speed of approximately 4 to 7 rpm., and most preferably on the order of about 5.5 rpm. This most preferred rate of rotation will provide approximately 11 therapy strokes per minute, such strokes being applied by lifting rollers 62.

The operation of this invention is shown in schematic FIGS. 4 and 5, which illustrates the device in two different orientations with respect to the cervical vertebrae 74. Cervical vertebrae 74 include the several neck bones 76, immediately adjacent to skull 80, and the first thoracic vertebra 78. As illustrated in FIG. 4, lifting rollers 62 have centerlines which are spaced apart by substantially less than the length of the adult cervical spine, such that the entire array of roller fits immediately adjacent to the cervical spine.

As rotatable array 22 turns, one of the lifting rollers 62 will engage the patient's cervical spine area beginning at the lower end thereof (that is, at the right end), as illustrated in FIG. 4, and rising to follow and form the cervical spine curvature. Such action lifts the entire cervical spine until such lifting roller 62 contacts the center area of the patient's cervical spine, as illustrated in FIG. 5.

This lifting action places the cervical spine in traction by virtue of the force of gravity acting through the weight of the patient's head and body, and provides effective intersegmental traction. During such lifting action, the radius of curvature of the cervical spine is shortened. Such shortened curvature is represented by curve 86 in FIG. 5.

As such lifting roller 62 continues along a downward curve toward the upper end of the cervical spine, the other lifting roller 62 will begin to contact the lower area of the patient's cervical spine, as again illustrated by FIG. 4. At this point, an intervening roller 64 will be in the center area of the patient's cervical spine, providing a degree of desirable support between the therapy strokes of lifting rollers 62.

As previously noted, this will prevent flattening of the spine between lifting strokes and eliminate discomfort for the patient. While the cervical spine is still supported, its curvature has relaxed as represented by curve 84 in FIG. 4, which has a greater radius than curve 86.

Electric motor 20 is preferably a shaded pole motor of the type drawing less than 0.5 amps. The housings for electric motor 20 and reduction gear assembly 18 are preferably made of heavy duty zinc die castings. The gears (not shown) preferably include both steel and bakelite gears. The motor and gears are chosen such that there is sufficient torque to perform the lifting action effectively and yet to avoid damage to the motor.

Carrier plates 48 and 50 are preferably steel. Bushings 68 therein are preferably bronze. Central shaft 52 is preferably a steel tube and drive shaft 54 is made of hardened steel, as are fixed screw shafts 66.

Base member 12, end members 14, casing 26, and short surrounding wall 36 are preferably made of wood, but may be made of metals or plastics or any other suitable material. Cover sheet 24 is preferably a strong soft vinyl material which has two layers such that a thin foam pad is included. Such cover material can easily be cleaned between use by different patients. Annular foam outer members 72 of lifting rollers 62 are preferably a resilient flexible foam such as polyether-polyurethanes.

While the principles of this invention have been described in connection with specific embodiments, it should be understood clearly that these descriptions are made only by way of example and are not intended to limit the scope of the invention.

What is claimed:

1. In a device for applying intersegmental traction to a patient's cervical spine of the type having an array of elongated parallel rollers rotatable about a main axis which is substantially parallel to that of the rollers, the improvement comprising:

two lifting rollers spaced about 180 degrees apart about the main axis and having centerlines spaced apart by no more than the length of the adult cervical spine such that the entire array of rollers fits immediately adjacent to the cervical spine, said lifting rollers having first outermost peripheral portions at a first radial distance from the main axis;

two intervening rollers each spaced substantially equally between and on either side of each of the lifting rollers and having second outermost peripheral portions at a second radial distance from the main axis, the first radial distance being substantially greater than the second radial distance to the extent that when a lifting roller is centered on the cervical spine it is the only roller in supporting contact therewith, and;

said second outermost peripheral portion of each intervening roller extending beyond the common tangent line of the lifting rollers so that when the two lifting rollers are equidistant from the center of the cervical spine both of them and an intervening roller are in concurrent supporting contact with the patient's neck along the natural posterior concavity of the cervical spine, whereby repetitive intersegmental traction may readily be applied to improve cervical curvature without intervening periods of unsupported curvature collapse.

2. The intersegmental traction device of claim 1 wherein the lifting rollers are of greater diameter than the intervening rollers and have soft resilient outer surfaces.

3. The intersegmental traction device of claim 2 wherein each of the lifting rollers comprises an inner rod and an annular foam outer member forming the outer surface.

4. The intersegmental traction device of claim 1 wherein the rollers are rotatable idler rollers.

* * * * *